US005580094A

United States Patent [19]

Ruehlman et al.

[11] Patent Number: 5,580,094

[45] Date of Patent: Dec. 3, 1996

[54] IN-LINE SKATE WALKING GUARD

[76] Inventors: Dana L. Ruehlman, 5781 Rustic Knolls Dr., Boulder, Colo. 80301; R. Igor Gamow, 186 Cañon Park, Boulder, Colo. 80302

[21] Appl. No.: 499,855

[22] Filed: Jul. 10, 1995

[51] Int. Cl.[6] ..... A63C 17/20

[52] U.S. Cl. ..... 280/825; 280/811; 36/132

[58] Field of Search ..... 280/825, 11.22, 280/811; D21/226, 230; 36/132, 136

[56] References Cited

U.S. PATENT DOCUMENTS

| | | | |
|---|---|---|---|
| 3,861,697 | 1/1975 | Dolce | 280/825 |
| 4,365,828 | 12/1982 | Hall et al. | 280/825 |
| 4,382,615 | 5/1983 | Gronborg et al. | 280/825 |
| 5,183,292 | 2/1993 | Ragin, III | 280/825 |
| 5,290,065 | 3/1994 | Kassal | 280/825 |

FOREIGN PATENT DOCUMENTS

| | | | |
|---|---|---|---|
| 2065834 | 10/1993 | Canada | 280/825 |

*Primary Examiner*—Brian L. Johnson

[57] ABSTRACT

A removable wheel guard for an in-line type skate. The guard includes an elongated channel to receive the wheels with an upwardly curved forward portion to inwardly receive the front wheel. An adjustable bridle is coupled to the base of the channel for the purpose of firmly attaching the guard to the rear of the skate.

5 Claims, 2 Drawing Sheets

IN-LINE SKATE WALKING GUARD

FIELD OF THE INVENTION

The present invention relates to a guard for the wheels of an in-line roller skate. In particular, the invention is a removable guard designed to fit over the wheels of an in-line skate in such a manner as to facilitate walking.

BACKGROUND OF THE INVENTION

In recent times, in-line type roller skates have become extremely popular. This type roller skate is most often identified as a ROLLERBLADE (ROLLERBLADE being the trademark of Rollerblade Inc.) and is distinguished from other roller skates by having three or more linearly aligned wheels.

In-line skates suffer from a problem that has plagued roller skates from their beginning. All forms of roller skates are unstable when the wearer has to walk on an uneven surface while wearing the skates. Stairs, sand, gravel and wet surfaces are examples of surfaces which are difficult to traverse while wearing in-line skates. Other problems include the wheels marking surfaces and surface damage from the high forces exerted by the wheels due to their small contact area. Many businesses currently outlaw in-line skates thus skaters must remove their skates before entering the premises which often requires that the skater carry an additional pair of shoes. Besides damage to property most buildings prohibit in-line skaters for the safety of persons walking in the building and for the skaters safety as well.

In the prior art, a number of skate accessories have been developed in an attempt to overcome the above noted problems. For example skate guards such as taught in U.S. Pat. Nos. 30,627 to Gibbs, 1,174,601 to Nathan, and 3,583,720 to Fowlkes address the problem of protecting the blades of ice-skates and do not address the problem of immobilizing the wheels on in-line skates. Wheel covers for roller skates have been addressed by Grim (U.S. Pat. No. 4,355,474), Dolce (U.S. Pat. No. 3,861,697), Loredo (U.S. Pat. No. 4,413,842), and Melendez (U.S. Pat. No. 4,364,187) but all are designed for roller skates that have tandem wheels. Zurnamer, U.S. Pat. No. 5,303,955, describes a roller skate wheel guard made of cloth which protects the wheel but does not provide stability for walking. Kassel in U.S. Pat. No. 5,290,065, describes a flexible rollerblade guard which is designed to prevent wheel rotation. However the design is cumbersome to attach and not practical for most styles of in-line skate which have a rearward extension to receive a rubber brake. Anderson et. al. in U.S. Pat. No. 5,236,224 teaches a in-line skate accessory which facilitates walking. This design covers only the front and rear wheels and relies on a rubber-like material to attach the cover and prevent wheel rotation.

SUMMARY OF THE INVENTION

The present invention is a unique guard designed to cover and immobilize the wheels of an in-line skate. The guard receives the linearly aligned wheels of an in-line skate and prevents rotation of the wheels by attachment of the guard to the skate by a bridle. The body of the guard forms a wheel retaining channel which extends forward to form an upwardly curved portion to receive the front wheel of the in-line skate. A bridle is connected to the wheel retaining channel in the rear third of the length of the guard. The bridle extends upwardly over the in-line skate in the area below the boot heel and above the rear wheel over the rear brake assembly. The bridle can be made of either a flexible but non-elastic material or an elastic material such that when attached to the skate it can be adjusted to fit the unique length and shape of each brand of skate. The non-elastic bridle can be changed in size by the adjustment of a buckle.

The wheel retaining channel has inside wall to wall dimensions which approach the thickness of the skate wheels. The channel receives, covers and retains the lower portion of the wheels. The lateral walls of the channel prevent the wheels from separating from the guard while the base provides support for the wheels on the inner surface and support for the person wearing the skates on the outer surface.

When the front wheel of the in-line skate is engaged in the front wheel reciever, with a substantial portion of the circumference of the front wheel being covered by the guard, the remaining wheels are in the wheel retaining channel and the bridle is firmly attached below the boot heel and above the rear wheel over the rear brake assembly, the guard effectively prevents rotation of all the wheels. The in-line skate guard provides a stable platform on which the skate wearer can safely walk without fear of the wheels rotating.

Additionally the guard is designed for use on any in-line skate irregardless of brand or design. Each size and brand of in-line skates have different sized wheels, length of the linearly aligned wheels and configuration of the rear brake assembly. To permit the in-line skate guard to fit all styles of skate the guard is constructed of a resilient material such as but not limited to plastic or rubber allowing the guard to be adapted to varying sizes by cutting off any excessive length. Also the size of the bridle can be altered in length either by inherent elasticity of the material or by changing the length of non-elastic material to fit over all types of rear brake and wheel assemblies.

OBJECTS OF THE INVENTION

To provide a light weight and easy attachable skate guard allowing persons to safely wear in-line skates while walking.

DETAILED DESCRIPTION OF THE INVENTION

Figure 1:
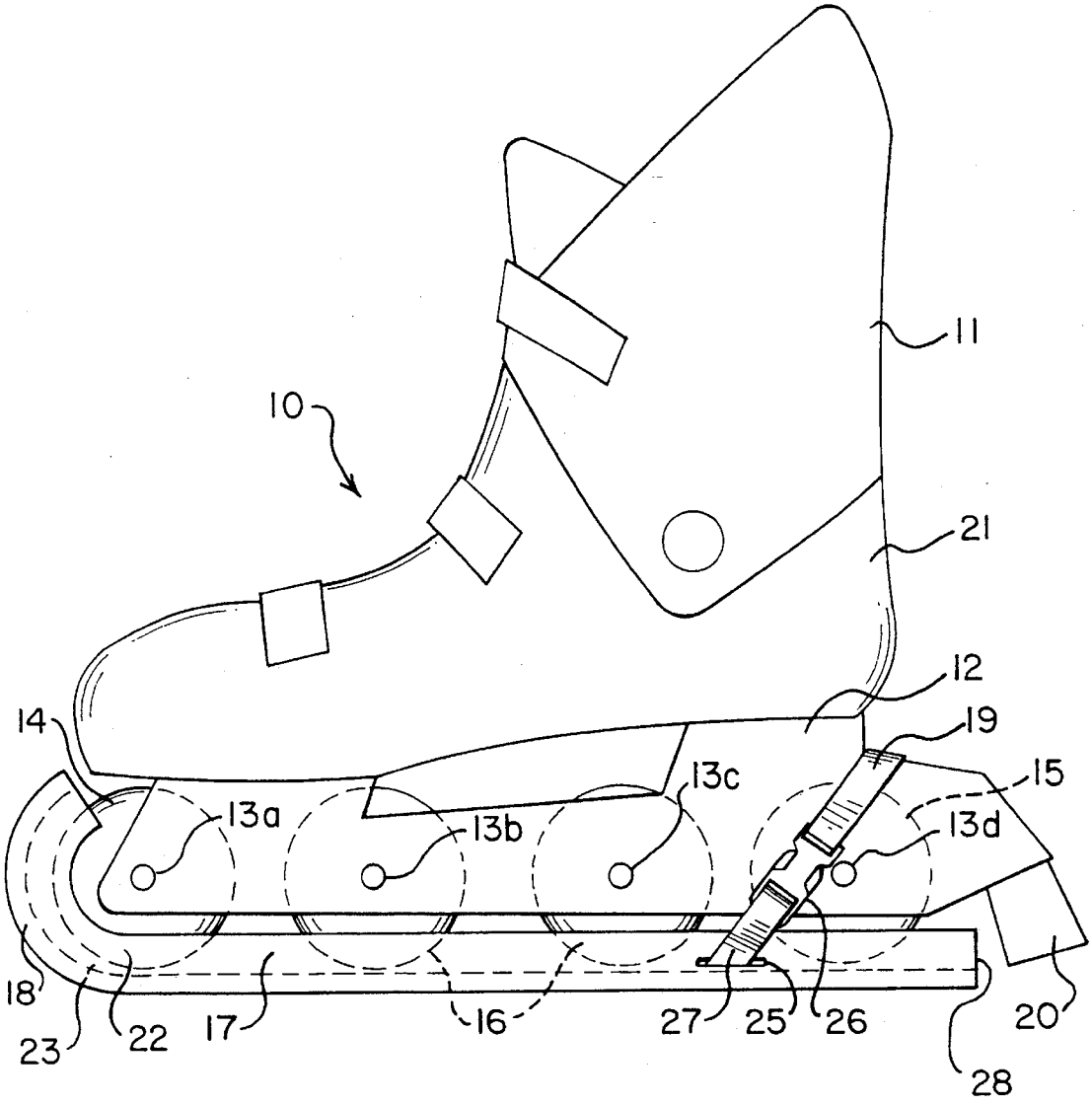
FIG. 1 is a representation of the invention used on a in-line skate.

In reference to FIG. 1, an in-line roller skate 10, is represented with a boot 11. The boot 11, is attached to the upper portion of the in-line skate wheel assembly 12. The wheel assembly extends from the upper assembly to support each axle 13*a*,13*b*,13*c*,13*d*, on which the front wheel 14, rear wheel 15, and a variable number (ranging from 1 to 3) of intermediate wheels 16, are mounted.

The novel in-line skate guard includes a wheel retaining channel 17, which receives the wheels of the in-line skate. At the front most portion of the wheel retaining channel the side walls 22,23, are upwardly curved to form the front wheel receiver 18. Coupled to the wheel retaining channel via a bridle opening 25, is a rearwardly angled adjustable bridle 19. The adjustable bridle 19, may be of two types—elastic or nonelastic. The elastic type could be made of but not limited to a metal spring, rubber bungee cord or a type of plastic such as polyurethane, ABS, PVC, or polyethylene. The non-elastic type could be constructed of but not limited to a strap made of nylon, leather or cotton webbing with an adjustable quick release buckle 26. When the wheels of the in-line skate 10, are in the wheel retaining channel 17, and the front wheel 14, is in the front wheel receiver 18, the bridle 19, in the case of the non-elastic type, has one half of its length passed over the wheel assembly 12, below the boot heel 21, and above the rear brake assembly 20. The two ends of the buckle 26, are then connected. The bridle 19, can be adjusted for a tight fit by shortening the length of the webbing 27 where it passes through the buckle. In the case of an elastic bridle 19, the bridle 19 is constructed of a single piece of material. In this type to attach the wheel retaining channel 17 to the in-line roller skate 10 the elastic bridle is first placed over the rear brake assembly 20 and then the wheel retaining channel 17, is pulled forward against the tension of the elastic material until the front wheel 14, can be engaged in the front wheel receiver 18. The force of the elastic material holds the wheels 14, 15, 16, in the wheel retaining channel 17. In the event the wheel retaining channel 17, is longer than the wheel assembly 12, and rear brake assembly 20, it may be desirable to cut off the open end 28, of the wheel retaining channel as required to render the length of the channel more compatible with the length of the blade.

Figure 2:
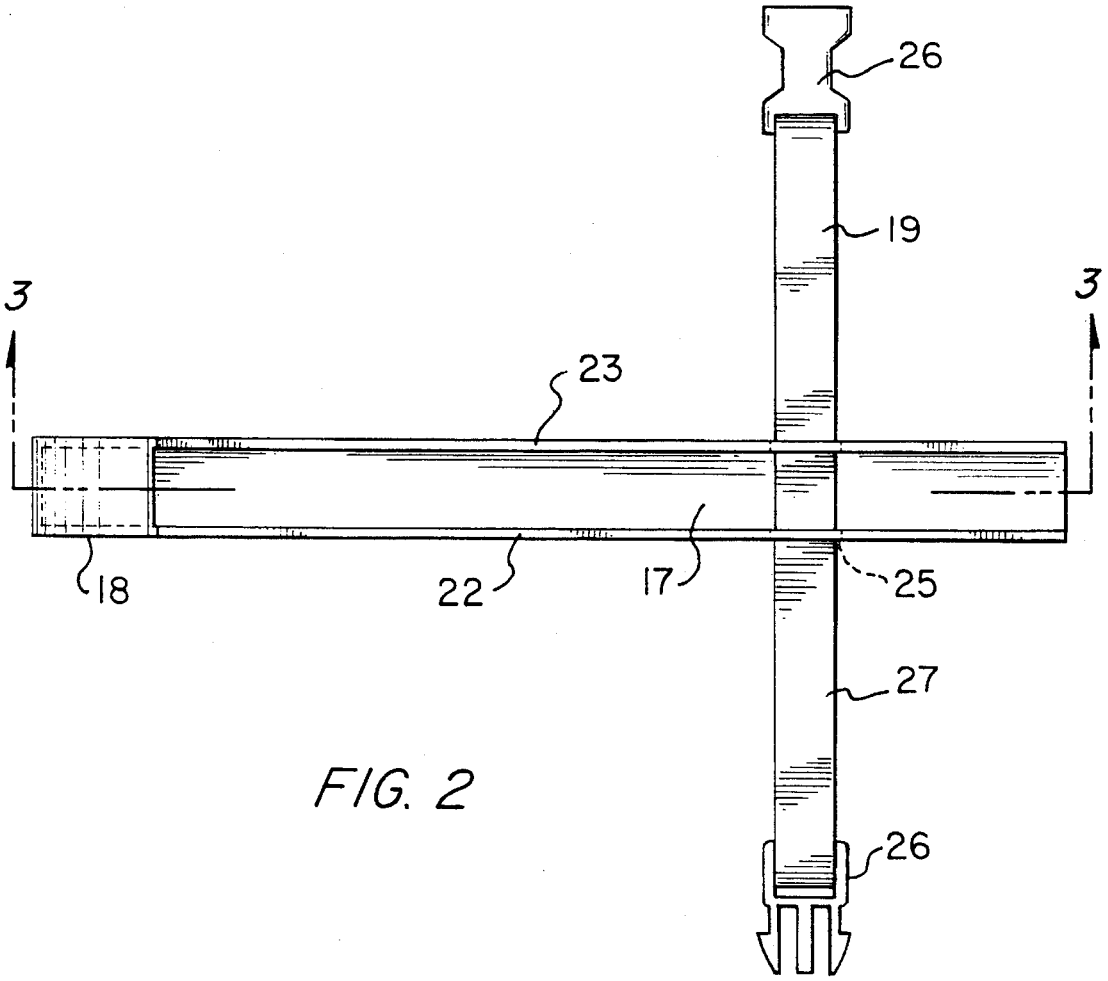
FIG. 2 is a representation, in top plan view, of the invention.

FIG. 2 is a top view depicting the relationship of the wheel retaining channel 17, to the side walls 22, 23, and front wheel receiver 18. The bridle 19, is depicted as a non-elastic type and is shown passing through the bridle opening 25. At each end of the bridle is one half of a quick release buckle system 26.

Figure 3:
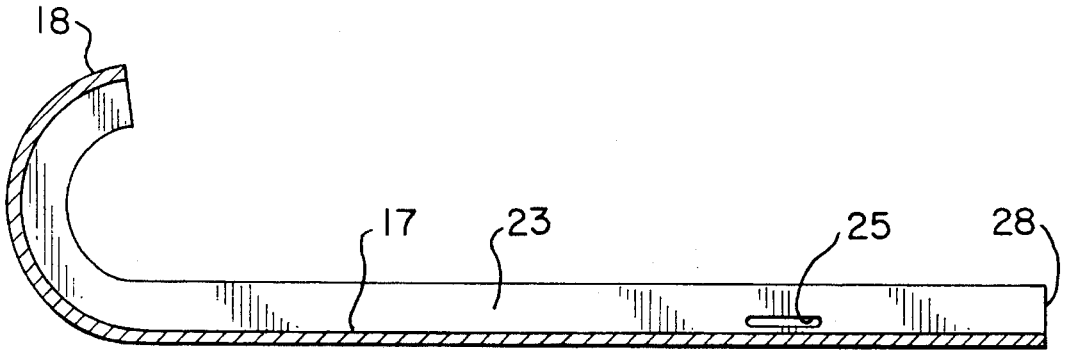
FIG. 3 is a representation, in side view, of the invention.

FIG. 3 is a side view of the invention depicting the wheel retaining channel 17, front wheel receiver 18, one side wall 22 and bridle opening 25.

Figure 4:
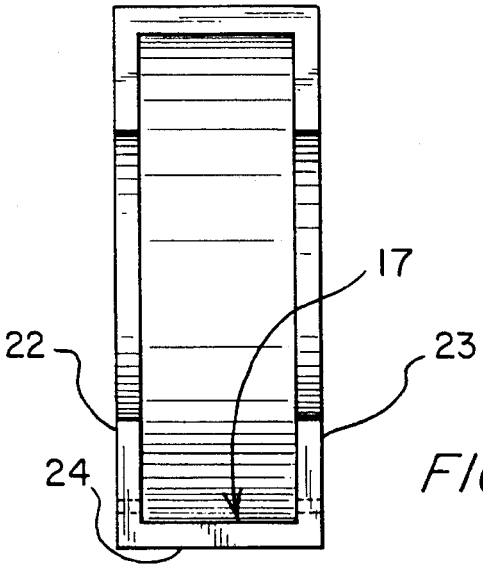
FIG. 4 is a representation of an end view of the wheel retaining channel of the invention.

FIG. 4 is an end view of the wheel retaining channel 17 depicting the side walls 22, 23, and base 24.

We claim:

1. A removable wheel guard for immobilizing a plurality of wheels on a in-line skate having said plurality of wheels arranged in tandem alignment, said wheel guard comprising:

a) an elongated base portion having a centrally disposed longitudinal recess for receiving a plurality of wheels therein;

b) the recess being defined by a first wall and a second wall in parallel arrangement;

c) the recess being provided with a wheel supporting surface for receiving a portion of each wheel of said plurality of wheels;

d) the first and second walls extend upwardly and forwardly from the base and in joining form a recess for inwardly receiving a substantial portion of the circumference of the front wheel of the in-line skate;

e) the base having an elongated circular opening in each said wall of the rear third of the length of the base wherein the circular openings are located above the wheel supporting surface;

f) the elongated circular openings allow for through passage of a bridle;

g) the bridle being coupled to each wall and extending over the wheel assembly of the in-line skate below a boot heel of the inline skate and above a rear brake assembly.

2. A wheel guard as in claim 1 wherein the wheel guard is constructed from a resilient material having the characteristics of resistance to cutting.

3. A wheel guard as in claim 1 wherein the wheel guard is constructed from a resilient material having sufficient rigidity to substantially retain the original configuration thereof during use.

4. A wheel guard as in claim 1 wherein the bridle is constructed of a flexible non-elastic material such that the bridle can be adjusted by a buckle system to fit over the rear brake assembly.

5. A wheel guard as in claim 1 wherein the bridle is constructed of a flexible elastic and the bridle is in the form of a single rearwardly facing loop which stretches over the rear brake assembly of an in-line skate.

* * * * *